US007182045B2

(12) United States Patent
Harth, III

(10) Patent No.: US 7,182,045 B2
(45) Date of Patent: Feb. 27, 2007

(54) SPLIT RING CASTING FOR BOILER TUBES WITH PROTECTIVE SHIELDS

(75) Inventor: George H. Harth, III, Wadsworth, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 10/802,474

(22) Filed: Mar. 17, 2004

(65) Prior Publication Data

US 2005/0205018 A1 Sep. 22, 2005

(51) Int. Cl.
*F22B 37/10* (2006.01)

(52) U.S. Cl. ..... 122/511; 248/901; 165/172

(58) Field of Classification Search ..... 122/510, 122/511, 6 A; 165/162, 172, 178; 248/901
See application file for complete search history.

(56) References Cited

U.S. PATENT DOCUMENTS

| | | | | |
|---|---|---|---|---|
| 3,809,018 | A * | 5/1974 | Pratt et al. | 122/510 |
| 4,285,396 | A * | 8/1981 | Schwoerer et al. | 165/162 |
| 5,404,941 | A * | 4/1995 | Jacksits | 165/162 |
| 5,724,923 | A * | 3/1998 | Green | 122/511 |
| 6,006,702 | A * | 12/1999 | Harth et al. | 122/511 |

* cited by examiner

*Primary Examiner*—Gregory Wilson
(74) *Attorney, Agent, or Firm*—Michael J. Seymour; Eric Marich

(57) ABSTRACT

A series of upright boiler tubes periodically exposed to the abrasive action of a stream of blowing fluid cleaning medium. Vertically spaced shields mounted on the boiler tubes for protection from the fluid cleaning medium. A split ring casting located between the protective shields to maintain the boiler tubes in an aligned and fixed spaced relationship. The split ring casting is sized to overlap adjacent portions of the protective shields thereby covering any gaps exposing the boiler tubes to the action of the fluid cleaning medium.

12 Claims, 3 Drawing Sheets

SPLIT RING CASTING FOR BOILER TUBES WITH PROTECTIVE SHIELDS

FIELD AND BACKGROUND OF INVENTION

The present invention relates, in general, to a series of pendant boiler tubes fitted with shields for protection from sootblower erosion, and to a rigid structure used to maintain these pendant boiler tubes in parallel alignment in a predetermined spaced-apart configuration. More particularly, it relates to a split ring casting structured to cooperate with the tube shields in protecting the pendant boiler tubes from sootblower erosion.

Today's boiler systems are designed for long-term operational availability and high efficiencies. Part of the efficiency improvement is due to higher operating pressures and steam temperatures. From an efficiency point of view, boilers are designed to maximize the steam output with a minimum of fuel expended. This is accomplished through the maximization of the heat rate, i.e., fuel consumption, residence time in the heat transfer sections of the boiler, and maximization of the heat contact surfaces. However, buildup, slagging, and fouling of the boiler tubes will increase the insulation effect on the tubes, which does not allow for effective thermal transfer. This requires more fuel to maintain an adequate steam output. It also causes higher velocity through the heat transfer tube sections. This, in essence, reduces the residence time of the convective heat against the heat transfer surfaces which deteriorates the thermal transfer efficiency and requires more fuel to maintain the desired steam output.

Cleaning highly heated surfaces, such as the heat exchange surfaces of a boiler has commonly been performed by mechanical devices generally known as sootblowers which are used for on-line removal of fouling deposits from the boiler tube surfaces on a periodic basis. Sootblowers typically employ saturated steam, superheated steam, compressed air, water, or a combination thereof, as a blowing medium which is directed through a nozzle against encrustations of ash, slag, scale, and other fouling materials that are deposited on the heat exchange surfaces. Sootblowers of the retracting variety employ a long lance tube which is periodically advanced into and withdrawn from the boiler through a wall port, and is simultaneously rotated such that one or more blowing medium nozzles at the end of the lance tube project jets of blowing medium tracing helical paths.

Experience has shown that boiler tubes whose outer surfaces are subjected to impact by the high velocity and abrasive blowing medium suffer from erosion and wear. The problem of heat exchanger surface deterioration has been particularly severe in connection with cleaning the rigidly held tube bundles such as those made up of pendant boiler tubes found in large scale boilers. Since the pendant tubes are rigidly held, they cannot readily distort in response to the temperature induced shrinkage and expansion occurring during a cleaning cycle. Difficulties are also present in an effort to produce adequate cleaning performance while avoiding thermal overstressing since the heat exchanger tube surfaces to be cleaned are of varying distance from the lance tube nozzle and therefore a varying speed of blowing medium jet progression across the heat exchanger surfaces occurs. Areas of slow progression may receive excessive quantities of sootblowing medium as compared to the amount required for effective cleaning. Thus, physical deterioration of the heat exchanger surfaces may occur where the tubes are over-cleaned in this manner. Such degradation of the tubular heat exchange surfaces of a boiler can produce catastrophic failures and a significant financial loss for the boiler operator.

Accordingly, a protective device in the form of a shield is provided to prevent direct impingement of the outer surfaces of the tubes by the sootblower blowing medium while allowing the tubes to be cleaned of ash, slag, scale and other fouling deposits. The shield is normally comprised of an axially elongated member of arcuate cross section sized to fit over the outer surface of the tube to protect the portion of the tube which is impacted by the cleaning medium.

The described shield works well in protecting the outer surfaces of the tubes from the high velocity and abrasive blowing medium, but a problem arises when it is used with vertically elongated tubes such as those forming pendant heat transfer surfaces, located in the boiler furnace and convection pass, and referred to in the industry as superheaters and reheaters whose respective inlet and outlet headers and major supports are housed in a section referred to in the industry as the penthouse, the latter being situated above the furnace and convection pass roof line. The pendant loops of these tubular heat transfer surfaces support themselves in simple tension and are subjected to stresses due to differences in expansion between the different loops since their average temperatures are different because the fluid flowing along the tubes from the inlet to the outlet header is being heated. Therefore, it is desirable and necessary to provide split ring castings to maintain the pendant tubes in parallel alignment and spaced with respect to each other.

Referring to the prior art as illustrated in FIGS. 1 and 2, wherein like reference numerals denote like elements, there is shown a row of vertical lengths of essentially parallel boiler tubes 10 which are kept in alignment and spaced from each other by a rigid structure known in the industry as a split ring casting which is comprised of two halves 14 that are shaped with arcuate or semicircular grooves to fit around portions of the boiler tubes 10. The two halves are drawn together and clamped or fastened around the boiler tubes 10 by a cross-bar 18 to maintain the pendant tubes 10 in parallel alignment and spaced with respect to each other. A retainer shield 20 conforming to the external dimensions of the front end of the split ring casting is welded thereto as indicated at weld area 22, shown in FIG. 1. The boiler tubes 10 are fitted with semi-cylindrical shaped tube shields 24 for protection against the abrasive impingement of the high velocity fluid cleaning medium being ejected from sootblower nozzles, not shown. The tube shields are spaced from each other and cooperate with the outer surface of boiler tube 10 to form a recess 28 therebetween, as shown in FIG. 2. A serious problem has been encountered with this prior art arrangement due to the difference in thermal expansion of the tube shields 24 relative to the boiler tubes 10 at high boiler operating temperatures, that has resulted in the gaps 26 being formed between the tube shields 24 and the split ring casting 12 thereby exposing a portion of the outer surface of boiler tubes 10 to the abrasive impact of the high velocity sootblower fluid cleaning medium.

The aforementioned problem occurs in the unprotected tube area existing between the adjacent end faces of the tube shield 24 and the split ring casting 12. Efforts at structurally bringing these end faces together and eliminating any gaps 26 therebetween have met with failure as a result of the difference in thermal expansion of the tube shield 24 relative to the protected tube 10 at high boiler operating temperatures. Experience has shown that the gap 26 existing between the adjacent end faces of the tube shield 24 and the split ring casting 12 is one of the most vulnerable areas to sootblower tube erosion due to flow disturbances created around the split ring casting 12.

Accordingly, there is a need for a split ring casting structured to cooperate with the adjacent tube shields to insure that there are no boiler tube outer surface areas left unprotected from the abrasive impingement of the high velocity sootblower blowing medium.

SUMMARY OF THE INVENTION

The present invention is directed to solving the aforementioned problem of boiler tube surface erosion at the gaps formed between the tube shields and the split ring casting.

The present invention provides a rigid structure in the form of a split ring casting comprised of two halves, with each half having an inner face shaped with semicircular grooves such that when the two halves are mated, parallel and spaced apertures are formed to hold a row or series of boiler tubes in an aligned and fixed spaced relationship. A retainer shield covers the front of the split ring casting. The boiler tubes are fitted with sootblower erosion protective shields located above and below the split ring casting. In accordance with the present invention, the two halves of the split ring casting and the retainer shield are sized to overlap adjacent portions of the upper and lower protective tube shields thereby covering any gaps that may occur between the protective tube shields and the split ring casting resulting from the difference in thermal expansion of the tube shields relative to the boiler tubes at high boiler operating temperatures.

The various features of novelty which characterize the present invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
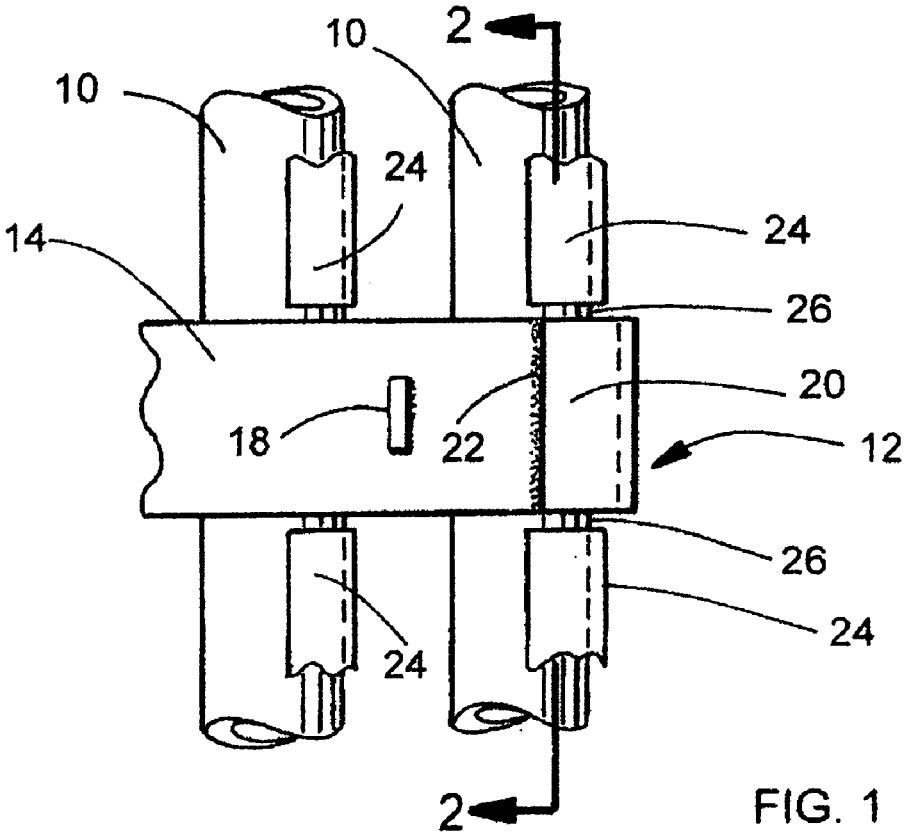
FIG. 1 PRIOR ART
FIG. 1 is a fragmentary sectional side view of a known split ring casting mounted on pendant boiler tubes fitted with protective shields, and illustrating the gap or spacing existing between the split ring casting and the tube shields.
Figure 2:
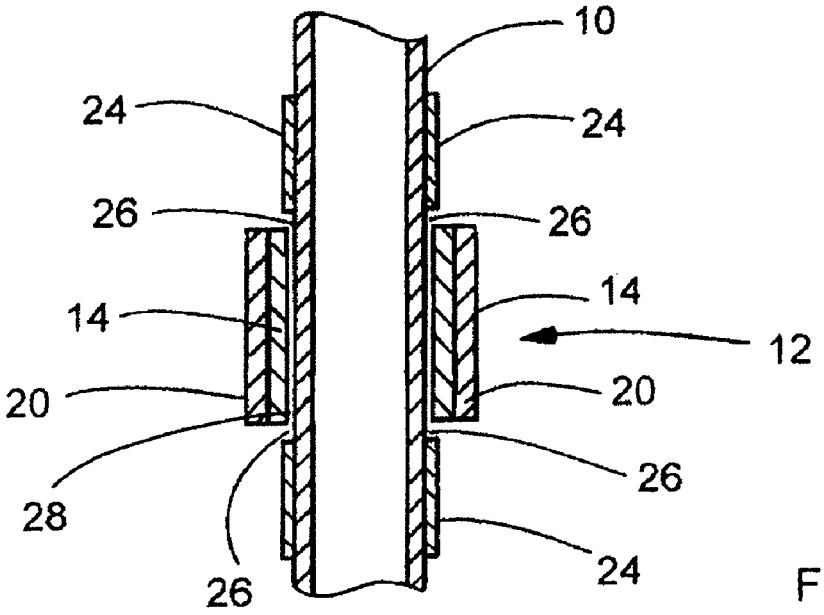
FIG. 2 PRIOR ART
FIG. 2 is a fragmentary sectional view taken along lines 2—2 of FIG. 1, and illustrating the gap or spacing between the known split ring casting and the tube shields.

Reference will hereinafter be made to the accompanying drawings wherein like reference numerals throughout the various figures denote like elements.

Figure 3:
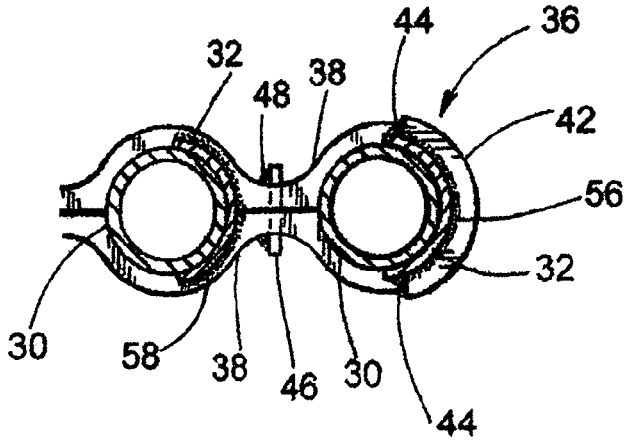
FIG. 3 is a fragmentary plan view of a split ring casting embodying the present invention.
Figure 4:
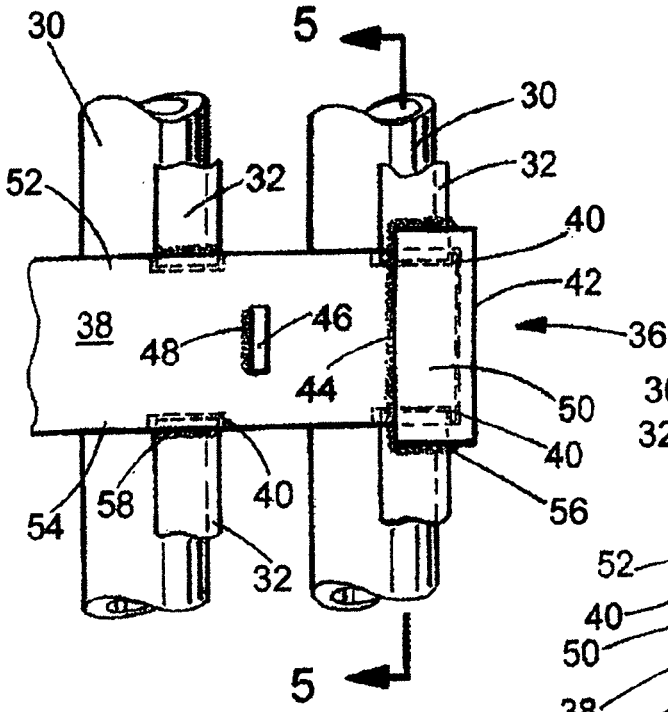
FIG. 4 is a fragmentary sectional side view of the split ring casting of the present invention.
Figure 5:
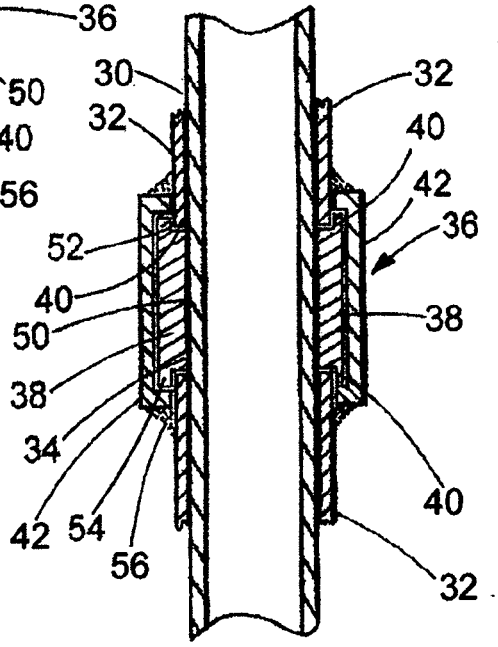
FIG. 5 is a fragmentary sectional view taken along lines 5—5 of the split ring casting shown in FIG. 4.

Referring now to FIGS. 3, 4 and 5 which embody the present invention, there is shown a row of vertical lengths of essentially parallel boiler tubes 30 fitted with upper and lower protective shields 32 which are spaced from each other and cooperate with the outer surface of the boiler tubes 30 to form the recess 34, as shown in FIG. 5. The boiler tubes 30 are kept in alignment and spaced apart by a split ring casting 36 comprised of two halves 38 whose inner faces or surfaces are shaped with arcuate or semicircular grooves to fit around portions of the boiler tubes 30 and the adjacent sections of the protective shields 32 thereby also covering the gaps 40 resulting from the difference in thermal expansion of the tube shields 32 relative to the boiler tubes 30 at high boiler operating temperatures. A retainer shield 42, conforming to the external dimensions of the front end of the split ring casting 36, fits around this front end the adjacent sections of the protective tube shields 32, and thus also covers the gap 40, as shown in FIGS. 4 and 5. The retainer shield 42 is welded to each of the two halves 38, as indicated at weld area 44, shown in FIGS. 3 and 4, and to the adjacent protective tube shields 32 as indicated at weld area 56. The two halves are drawn together and fastened or clamped around the boiler tubes 30 and the adjacent sections of the protective tubes shields 32 by a cross-bar 46 to maintain the boiler tubes in parallel alignment and spaced from each other. The cross-bar 46 is welded to the two halves 38 as indicated at weld area 48. Each of the two halves 38 has a T-shaped cross section with a central portion or tongue member 50 which faces the tubes 30 and fits into the recess 34 defined by the opposing sides of the upper and lower tube shields 32 and the outer surface of the tubes 30, and with the longitudinal end portions or lip members 52 and 54 that overlap the adjacent sections of the tube shields 32 to cover any gaps existing therebetween. The lip members 52 and 54 are preferably welded to the adjacent protective shields 32 as indicated at weld area 58 and as shown in FIG. 4. Thus, in accordance with the present invention, the gaps 40 lying within the recesses 34, and which would otherwise expose a portion of the outer surface of the boiler tubes 30 to abrasive impingement by the high velocity sootblower fluid cleaning medium, are covered and shielded from this abrasive cleaning medium by the overlapping lip members 52 and 54 of the two halves 38 and the retainer shield 42.

Figure 6:
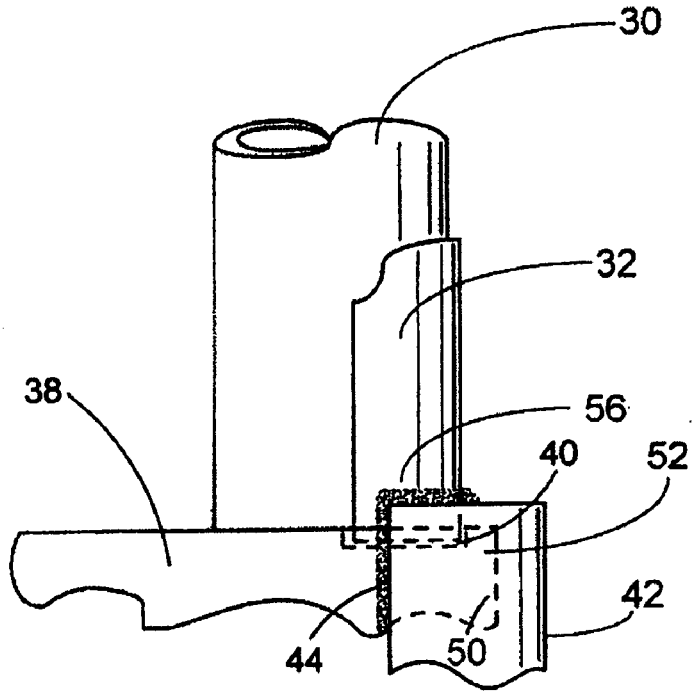
FIG. 6 is an enlarged detail of a portion of the sectional side view of the split ring casting shown in FIG. 4.
Figure 7:
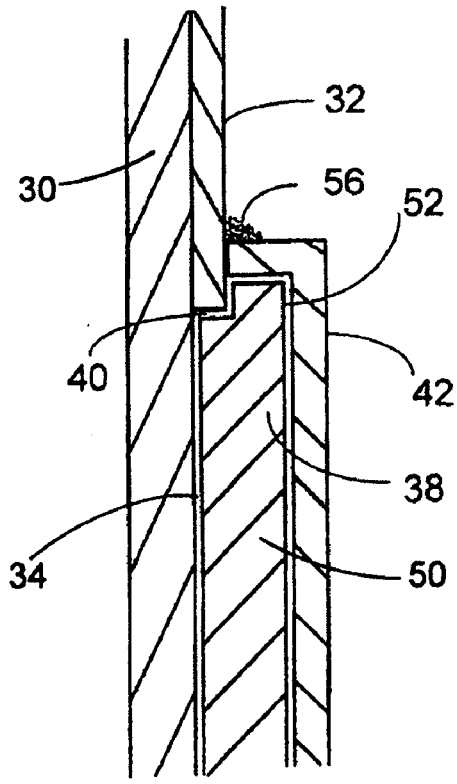
FIG. 7 is an enlarged detail of a portion of the sectional view of the split casting shown in FIG. 5.

Turning now to FIGS. 6 and 7, there are shown enlarged details of portions of the views shown in FIGS. 4 and 5, respectively. A portion of the tube 30 is fitted with the protective shield 32, and the latter is welded to the retainer shield 42 as indicated at weld area 56. The split ring casting half 38 includes the central portion or tongue member 50 extending into the recess 34 and the lip member 52 which covers the gap 40 existing between the protective tube shield 32 and the tongue member 50.

Although the present invention has been described above with reference to particular means, materials and embodiments, it is to be understood that this invention may be varied in many ways without departing from the spirit and scope thereof, and therefore is not limited to these disclosed particulars but extends instead to all equivalents within the scope of the following claims.

I claim:

1. A rigid structure comprised of two halves, arcuate grooves configured along the inner face of each of the two halves such that when the two halves are mated, parallel and spaced apertures are formed to hold a series of tubes in an aligned and fixed spaced relationship, the tubes undergo longitudinal thermal expansion and each tube is fitted with a respective tube shield mounted adjacent each of the two halves, and wherein the two halves are sized to overlap an adjacent portion of the tube shield thereby covering longitudinal gaps created therebetween while accommodating longitudinal thermal expansion of the shields and the tube.

2. The rigid structure according to claim 1, in which each arcuate groove includes a central portion projecting toward the tube and a longitudinal end portion overlapping the adjacent portion of the tube shield.

3. The rigid structure according to claim 1, including clamping means for securing the two halves around each tube and adjacent portion of the tube shield.

4. The rigid structure according to claim 1, in which the tube shield is welded to at least one of the two halves.

5. The rigid structure according to claim 1, in which a retainer shield covers the front end of the two halves, and the retainer shield is sized to overlap the adjacent portion of the tube shield.

6. The rigid structure according to claim 5, in which the retainer shield is welded to at least one of the two halves.

7. In combination, a row of vertical lengths of essentially parallel tubes that undergo longitudinal thermal expansion and have a side periodically subjected to the action of a stream of blowing fluid cleaning medium, spaced upper and lower tube shields mounted on said side of each tube to avoid direct impingement of the blowing fluid cleaning medium on the tube, a rigid structure disposed between the upper and lower tube shields and being comprised of two halves positioned on opposite sides of the tube row, each half having an inner face shaped with semicircular grooves such that when the two halves are mated, parallel and spaced apertures are formed to hold the tubes in an aligned and fixed spaced relationship, and wherein the two halves are sized to overlap adjacent portions of the tube shields thereby covering longitudinal gaps created therebetween while accommodating longitudinal thermal expansion of the shields and the tubes.

8. The combination according to claim 7, in which the inner face is formed with a central portion projecting toward the tubes, and longitudinal end portions overlapping the adjacent portions of the tube shields.

9. The combination according to claim 7, including clamping means for securing the two halves around the tubes and adjacent portions of the tube shields.

10. The combination according to claim 7, in which the tube shields are welded to at least one of the two halves.

11. The combination according to claim 7, in which a retainer shield covers a front end of the two halves, and the retainer shield is sized to overlap the adjacent portions of the tube shields.

12. The combination according to claim 11, in which the retainer shield is welded to at least one of the two halves.

* * * * *